United States Patent [19]

Lapp et al.

[11] 4,123,757

[45] Oct. 31, 1978

[54] RADAR SECTOR SCAN REVERSAL APPARATUS

[75] Inventors: Roger H. Lapp, Silver Spring, Md.; Jacob D. Schneider, Los Alamos, N. Mex.

[73] Assignee: The United States of America as represented by the Secretary of the Navy, Washington, D.C.

[21] Appl. No.: 714,732

[22] Filed: Aug. 16, 1976

[51] Int. Cl.[2] ..... H01Q 3/02

[52] U.S. Cl. ..... 343/766; 318/627

[58] Field of Search ..... 343/757, 763, 766, 760; 318/266, 282, 468, 627, 283, 284, 285

[56] References Cited

U.S. PATENT DOCUMENTS

| | | | |
|---|---|---|---|
| 2,713,121 | 7/1955 | Lyman et al. | 343/766 |
| 2,737,655 | 3/1956 | Dolberg | 343/763 |
| 3,187,333 | 6/1965 | Cioter et al. | 343/766 |
| 3,479,107 | 11/1969 | Blythe et al. | 343/763 |
| 3,530,268 | 9/1970 | Aubrey | 318/282 |
| 3,794,901 | 2/1974 | Gendreu et al. | 318/627 |

*Primary Examiner*—Eli Lieberman

*Attorney, Agent, or Firm*—R. S. Sciascia; A. L. Branning

[57] ABSTRACT

The present invention relates to a radar sector scan apparatus which reverses its direction of scan without causing large current spikes in the scan-producing motor. This result is achieved by switching off the motor before the instant at which the scan direction is reversed and letting the momentum of the antenna (attached to the motor shaft) continue the scan. Spring and bumper means are provided for slowing, stopping, and then reversing the scan while the motor is off. A switching arrangement is provided which switches off and switches on the motor at the appropriate times to effect smooth scanning and scan reversal. The invention also includes automatic start up logic.

9 Claims, 6 Drawing Figures

RADAR SECTOR SCAN REVERSAL APPARATUS

BACKGROUND OF THE INVENTION

The conventional method of reversing the direction of scan for a sector scan radar has been to apply a positive voltage to produce a scan in one direction and apply a negative voltage to produce a scan in the other direction. Previous scan systems have been overly complex using large amounts of power and requiring close synchronization among the rotating elements. This prior technique of antenna scanning is known as "plugging". Plugging places high stress on the electric drive circuits and induces demagnetization of the permanent magnets found in the stator. That is, the field in the motor armature opposes the stator field which causes the magnets of the stator to demagnetize.

The loss in magnetization is accompanied by a corresponding loss in torque. Plugging, therefore requires a large-size motor in order to accomplish rapid reversal of direction.

Some prior art optical scanners and radar scanners, although employing spring mechanisms to assist the scan reversing, have not solved the aforementioned problems. For example, U.S. Pat. No. 3,734,591 describes an optical scan apparatus wherein spring energy provides a one-way mirror scan with a rapid return feature. No provision is made for eliminating inordinate surges of current occurring during scan reversal.

SUMMARY OF THE INVENTION

The present invention overcomes many of these past problems by using kinetic energy storage means to initiate the antenna direction reversal, while at the same time using a specialized motor circuit to provide the required polarity reversal of voltage of a scan-producing motor. The kinetic energy storage means are embodied as a spring means having a linear response and mounted such that the means is driven into a stationary bumper means at either end of the antenna scan. The spring means stores the energy of the moving antenna by deforming or flexing, and causes the antenna to rebound by reflexing from the bumper in the opposite direction. Direction reversal is thus achieved in a time interval which is shorter than that which could be achieved by direct reversal of the motor drive voltage.

The present invention is provided with "self-start" circuitry which switches on the motor automatically in the correct direction should it come to rest in one of its normally unpowered regions, after the motor is switched off.

DESCRIPTION OF PREFERRED EMBODIMENT

Figure 1:
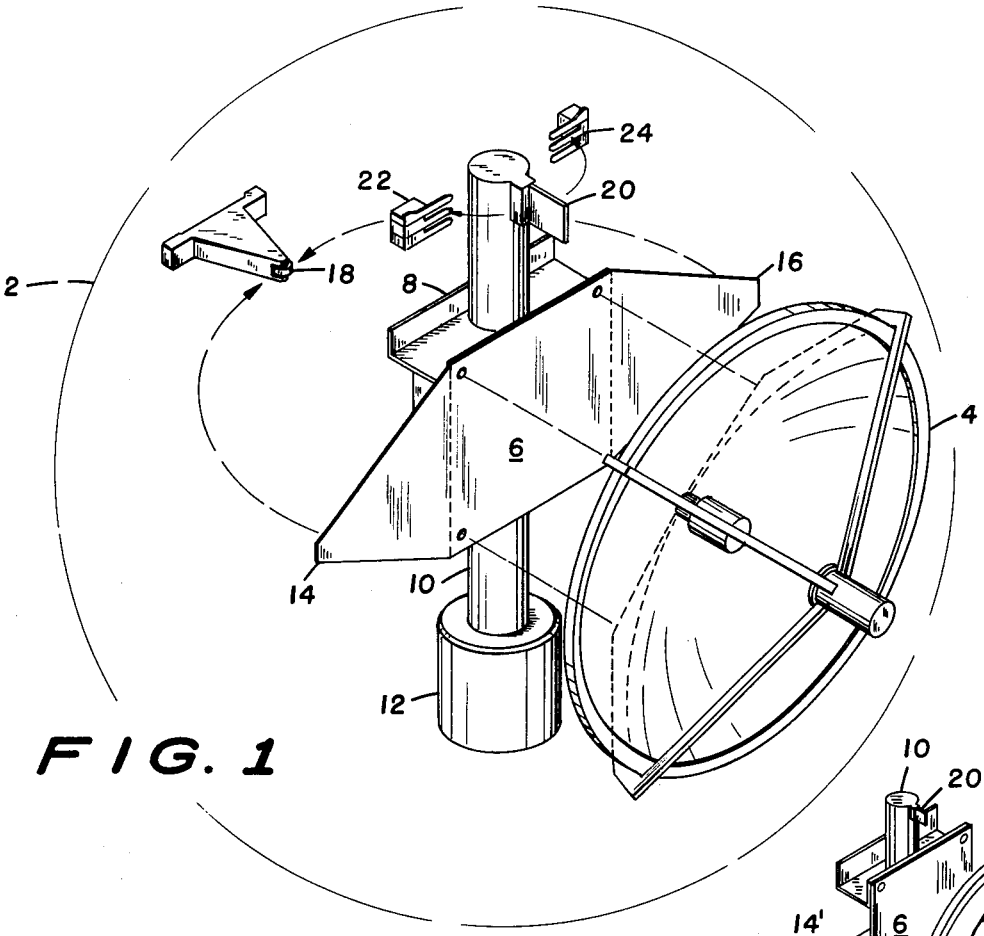
FIGS. 1 and 1A are perspective views of the present invention with the rotation of the apparatus being shown by dashed lines with arrowheads.
Figure 1A:
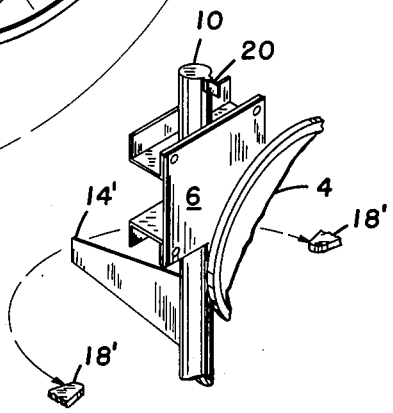
Figure 2:
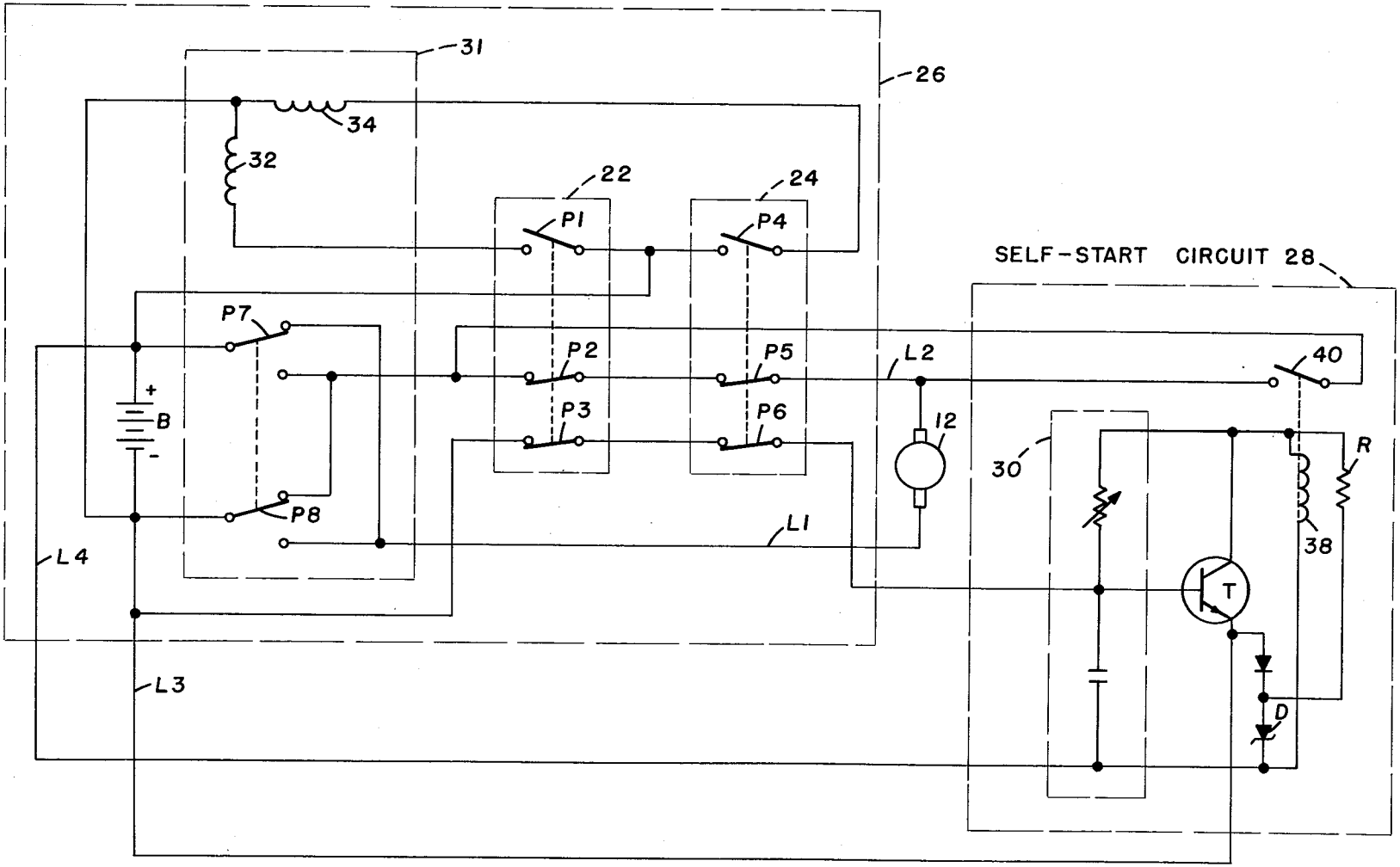
FIG. 2 shows the motor control circuit employed by the present invention.
Figure 5:
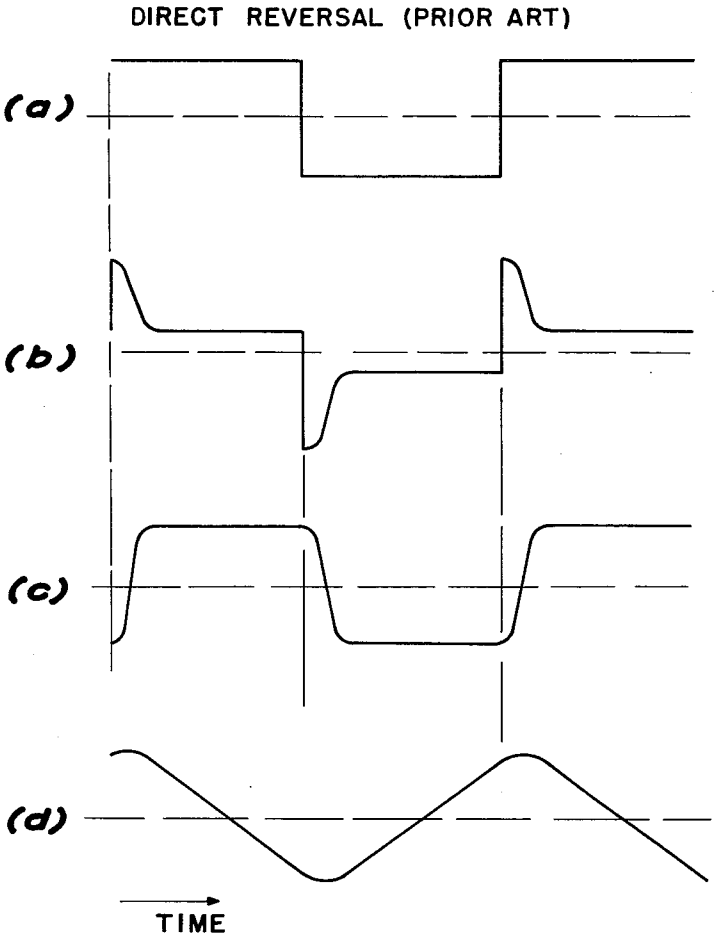
FIG. 5 is a series of graphs describing the operation over time of a prior art reversal scan apparatus.

Referring to FIG. 1, there is shown the radar sector scan reversal apparatus 2 of the present invention. An antenna 4 is shown attached to a plate 6. Plate 6 is attached to a member 8 which is attached to shaft 10 of a scan-producing motor 12. Motor 12 can produce a rotation of shaft 10 in either the clockwise or counterclockwise directions. Also attached to plate 6 are two spring means 14 and 16 which are shown as flat springs in the illustrated embodiment. Also shown in FIG. 1 is a bumper 18 which remains in a fixed position with respect to rotating shaft 10 and its attached flat srpings 14 and 16. (An arrangement of one flexible spring 14' cooperating with two bumpers 18' as shown in FIG. 1A is also within the scope of the invention.) Affixed to shaft 10 is an actuator member 20 placed on shaft 10 to activate switches 22 and 24 which switch off motor 12. (A single switch with two actuator members is also a modification contemplated by the invention although not in the preferred embodiment.) This switching process is produced by switching circuitry 26 which is attached to motor 12 and is shown in FIG. 2. Also seen in FIG. 2 is self-start circuit 28 attached to scan-producing motor 12.

Figure 3:
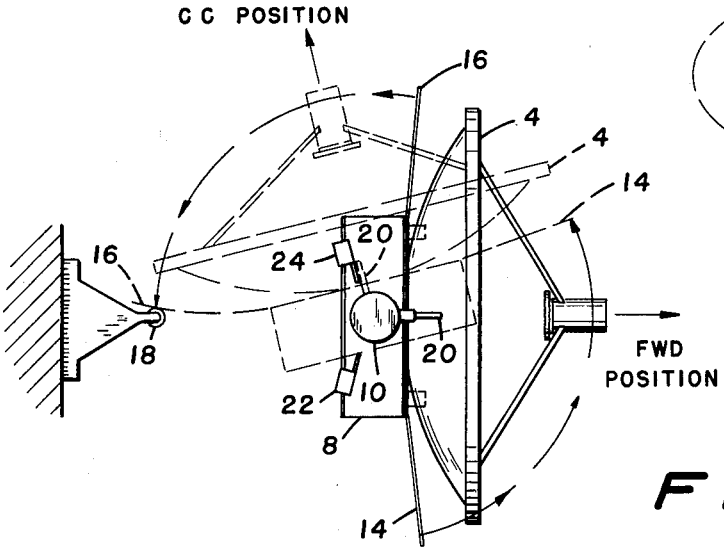
FIG. 3 is a top view of the present invention shown at different times.
Figure 4:
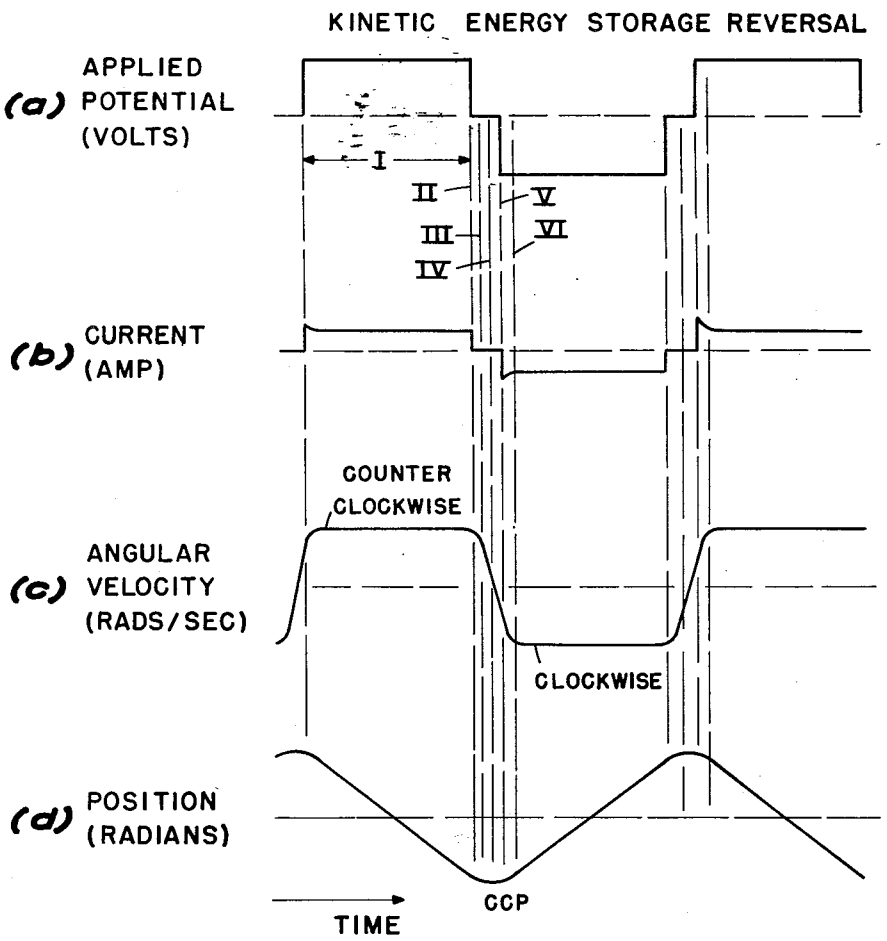
FIG. 4 is a series of graphs describing the operation over time of the present invention.

Referring now to FIG. 3, antenna 4 is shown at two different times, oriented in two different directions, as it sweeps in a counterclockwise fashion. Referring also to FIG. 4, *a* through *d*, the significance of the different positions of shaft 10 is made clear. In its first position, the FORWARD (FWD) POSITION, shaft 10 is being rotated counterclockwise under the power of motor 12 via switching circuitry (26 of FIG. 2). In this FWD POSITION, shaft 10 is at a time indicated as time interval I. Constant voltage is being applied (FIG. 4-*a*) resulting in nearly constant counterclockwise angular velocity (FIG. 4-*c*) and constant change in position (FIG. 4-*d*). As shaft 10 rotates counterclockwise, away from the FWD POSITION, in the direction of the arrows shown in FIG. 3, time II (FIG. 4) is reached, at which instant actuator member 20 depresses switch 24. Depressing switch 24 switches off the voltage being applied to motor 12. Applied voltage and current levels (shown in FIG. 4, *a* and *b*) drop to zero while angular velocity decreases due to the rotational friction of shaft 10. Thereafter, at time III, flat spring 16 comes into contact with bumper 18 thereby further decreasing angular velocity until time IV is reached. At time IV shaft 10 and attached antenna 4 have stopped rotating after having reached the second illustrated position of antenna 4, the furthest counterclockwise scan position (referred to as CC POSITION in FIG. 3). Before reaching this CC POSITION, flat spring 16 comes into contact with and is compressed against stationary bumper 18, thus storing energy in flexed spring 16. Time IV represents the instant at which the momentum of shaft 10 has been nullified by the force exerted by flat spring 16. Flat spring 16 then unflexes and shaft 10 with attached antenna 4 begins rotating in a clockwise fashion. This is shown by FIGS. 4-*c* and 4-*d*. The spring-assisted turn around process experiences energy losses due to friction and damping which cause shaft 10 to rebound with less velocity than it had when it entered the turn around cycle. It is thus desirable to supply makeup power to the motor before power would be restored by the normal reclosing of switch 24. This has the desirable effect of speeding up the turn around process.

The invention provides a self-start circuit 28, the first purpose of which is to boost the rotational angular velocity of shaft 10 between time V and time VI at which time switch 24 is released (i.e., no longer depressed) to permit voltage to be again applied to scan-producing motor 12 through the normal running circuit.

The preferred embodiment of the invention contemplates the use of an adjustable time delay 30 referenced from time II for the determination of time V in FIG. 4. In FIGS. 2 and 4 an adjustable time delay 30 is shown which activates self-start circuit 28. When either of the switches 22 or 24 is depressed pole switch $P_3$ or $P_6$ opens, respectively, which defines time II. A mechanical means for implementing the position interval between time II and time V can be used. However, time was preferred over position as a variable in that, given overly large friction or resistance, the position set by a mechanical system might never be reached to switch the motor on again; a preset time period would assure motor self-start under any circumstances regardless of external forces. This overcoming of external forces represents the second purpose of self start circuit 28. Further, if the entire scan apparatus is intentionally turned off and the scan comes to rest in a normally zero voltage position, the time delay will time out, and upon turning on the apparatus again the scan motor 12 will start with the correct direction of rotation. The adjustment of the time delay is tuned for smoothest and shortest turn around time consistent with the desire to minimize power consumption.

Referring back to FIG. 2, switching circuitry 26 is shown together with self-start circuit 28 in a cooperating arrangement. Under normal scan conditions exemplified by time interval I, spring-return three-pole switches 22 and 24 are in normal released (not depressed) position, causing the first pole switch $P_1$, of switch 22 to be open while the second and third pole switches $P_2$ and $P_3$ of switch 22 are closed. Similarly, first pole switch $P_4$ of switch 24 is open while the second and third pole switches $P_5$ and $P_5$ of switch 24 are closed. With $P_2$, $P_3$, $P_5$ and $P_6$ closed, voltage across battery B is applied across scan-producing motor 12. Pole switches $P_7$ and $P_8$ of a latching relay 31 are break-before-make and are connected between the battery B and the scan producing motor 12 in a standard double-pole, double-throw manner for reversing the direction of the motor. The "throwing" of latching relay 31 to reverse the direction of the motor is produced by magnetic coils 32 and 34 which are momentarily energized by the depressing of switches 22 and 24 respectively. The momentary energization of coils 32 or 34 provides continuity in the motor circuit by virtue of the latching type relay 31. The throwing of latching relay 31 occurs nominally at time II (shown in FIG. 4). Self-start circuit 28 is also shown in FIG. 2. When switches 22 and 24 are in their normal positions (shown in FIG. 2), i.e., during time interval I, self-start circuit 28 is not connected. At this time, transistor T is not conducting; a zero bias on transistor T across the emitter-base junction inhibits the flow of current from emitter to collector and thereafter through relay coil 38. When current is not flowing through relay coil 38, switch 40 remains in open position. The depressing of switch 22 or 24 (at time II) triggers the conventional adjustable time delay 30, which serves to switch the transistor T into the conduct mode at time V. When transistor T conducts, current flows through relay coil 38 which closes switch 40. The closing of switch 40 reconnects battery B across motor 12 by by-passing pole switches $P_2$ and $P_5$. Because this reconnection of motor 12 takes place when motor 12 is already rotating in the desired direction the current spike is minimized when voltage is reapplied. When motor 12 causes shaft 10 to move to the position where switches 22 and 24 are again both released, $P_2$, $P_3$, $P_5$, and $P_6$ are again in normal closed position and adjustable time delay 30 is reset; transistor T stops conducting; and switch 40 opens. The self-start circuit 28 is disconnected as time interval I is again reached. The same sequence repeats in each direction thereby effecting a uniform scan.

In sum, during time interval I motor 12 is connected to battery B through switching circuitry 26 producing a normal scan. At time II, before scan direction reversal, battery B is disconnected from motor 12. Antenna 4 attached to motor shaft 10 rotates under its own momentum until flat spring 14 or 16 comes into contact with bumper 18 (at time III) after which the scan stops (at time IV) and begins in the reverse direction impelled by the unflexing of flat spring 14 or 16. A presettable time later (at time V), determined by the adjustable delay timer 30, self-start circuit 28 automatically reconnects motor 12 to battery B, if necessary. At time VI self-start circuit 28 is turned off as motor 12 is again reconnected through switching circuitry 26 which has reconnected battery B across motor 12 to effect the properly directed reversed rotation. At time VI, the adjustable delay timer 30 is reset.

Figure 6:
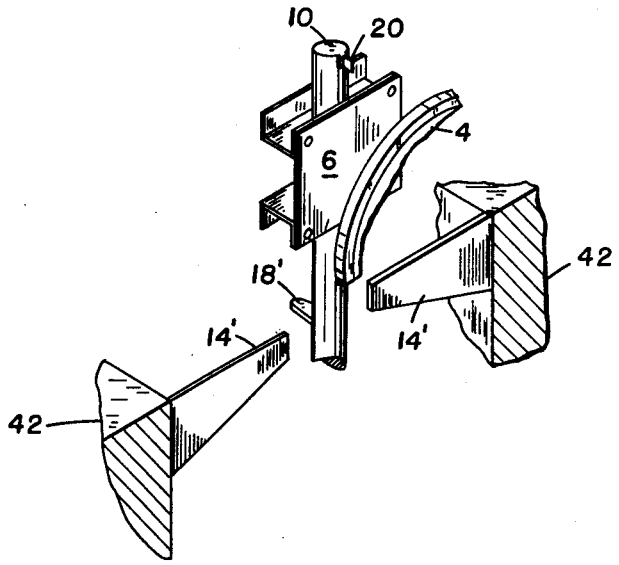
FIG. 6 illustrates an alternative embodiment of the present invention.

It should be understood that other changes and variations in the invention as embodied may be fashioned which are within the spirit and scope of the invention as contemplated and claimed, including the placement of the bumper means 18 (or 18') on the motor shaft 10 and the positioning of the spring means 14 affixed to a stationary element 42 as illustrated in FIG. 6 and 16 (or 14').

What is claimed is:

1. A radar sector scan reversal apparatus comprising:

a stationary element, a motor having a shaft which can rotate clockwise and counterclockwise, bumper means attached to the shaft, spring means affixed to the stationary element, said spring means being positioned such that said bumper means comes into contact with said spring means prior to the end of each clockwise or counterclockwise rotation and such that said spring means stores sufficient energy following each rotation to induce rotation in the opposite direction, means coordinated with the rotation of said shaft for switching off said motor before said spring means begins to release energy at the end of either a clockwise or counterclockwise rotation, and means for switching on said shaft rotating motor after the direction of shaft rotation is reversed, wherein the spring means comprises two spring members and wherein the bumper means comprises one bumper, such that one spring member contacts the bumper following a clockwise rotation and the other spring member contacts the bumper following a counterclockwise rotation, and wherein each of said spring members comprises:

a flat spring which flexes about an axis parallel to the axis of said shaft when the flat spring comes into contact with said stationary bumper means.

2. A radar sector scan reversal apparatus comprising:

an antenna, a shaft affixed to the antenna, a motor connected to the shaft for selectively rotating the shaft and affixed antenna in clockwise and counterclockwise directions, spring means attached to the shaft, bumper means which are stationary with respect to the rotation of the shaft and which are positioned such that said spring means comes into contact with the bumper means at a first set position during clockwise shaft rotation, said spring means storing energy which is later released thereby impelling said shaft into a counterclockwise reversed rotation and such that said spring means comes into contact with the bumper means at a second set position during counterclockwise shaft rotation, said spring means storing energy upon contact which is later released thereby impelling said shaft into a clockwise reversed rotation, means coordinated with the rotation of said shaft for switching off said motor before said spring means begins to release energy at the end of either a clockwise or counterclockwise rotation, and means for switching on said shaft rotating motor after the direction of shaft rotation is reversed, wherein the spring means comprises two spring members and wherein the bumper means comprises one bumper, such that one spring member contacts the bumper following a clockwise rotation and the other spring member contacts the bumper following a counterclockwise rotation, and wherein each of said spring members comprises:

a flat spring which flexes about an axis parallel to the axis of said shaft when the flat spring comes into contact with said stationary bumper means.

3. A radar sector scan reversal apparatus comprising:

an antenna, a shaft affixed to the antenna, a motor connected to the shaft for selectively rotating the shaft and affixed antenna in clockwise and counterclock directions, spring means attached to the shaft, bumper means which are stationary with respect to the rotation of the shaft and which are positioned such that said spring means comes into contact with the bumper means at a first set position during clockwise shaft rotation, said spring means storing energy which is later released thereby impelling said shaft into a counterclockwise reversed rotation and such that said spring means comes into contact with the bumper means at a second set position during counterclockwise shaft rotation, said spring means storing energy upon contact which is later released thereby impelling said shaft into a clockwise reversed rotation, means coordinated with the rotation of said shaft for switching off said motor before said spring means begins to release energy at the end of either a clockwise or counterclockwise rotation, and means for switching on said shaft rotating motor after the direction of shaft rotation is reversed, wherein the spring means comprises one spring member and wherein the bumper means comprises two stationary bumpers, such that the spring member contacts one bumper following a clockwise rotation and contacts the other bumper following a counterclockwise rotation.

4. A radar sector scan reversal apparatus, as defined in claim 3 wherein said switching off means comprises:

an actuator member affixed to said shaft, a first switch electrically connected to said motor, said first switch being activated by said actuator member to switch off said shaft rotating means before said first spring means begins to release energy and a second switch electrically connected to said motor, said second switch being activated by said actuator member to switch off said motor before said second spring means begins to release energy.

5. A radar sector scan reversal apparatus as defined in claim 4 further comprising:

a battery connected across said motor, a switching arrangement comprised of said first switch and said second switch for disconnecting said battery from said motor before said first spring means begins to release energy at the end of a clockwise rotation to effect a reversed, counterclockwise rotation and before said second spring means begins to release energy at the end of a counterclockwise shaft rotation to effect a reversed, clockwise rotation, and a relay arrangement connected between said battery and said motor for reversing the polarity of said motor when said first switch is deactivated or when said second switch is deactivated, thereby applying the polarity to said motor required to rotate said motor in the reversed direction of rotation.

6. A radar sector scan reversal apparatus as defined in claim 5 further comprising:

a coupling between said switching arrangement and said relay arrangement for changing relay position in response to the selective deactivation of said first switch and said second switch.

7. A radar sector scan reversal apparatus as defined in claim 3 wherein the switching on means comprises:

self-start circuit means electrically connected to said motor for automatically switching on said motor a preset period after the switching off of said motor.

8. A radar sector scan reversal apparatus as defined in claim 7 wherein said self-start circuit means comprises:

a self-start switch means electrically connected to said motor for switching on said motor and an adjustable time delay for triggering said self-start switch a period after the switching off of said motor.

9. A radar sector scan reversal apparatus as defined in claim 8 wherein the self-start switch means comprises:

a transistor which switches between conduct and nonconductive states.

* * * * *